US006651258B2

(12) United States Patent
Pelensky

(10) Patent No.: US 6,651,258 B2
(45) Date of Patent: Nov. 25, 2003

(54) ANTI-CLIMBING RESTRAINING STRAPS ON AN ARTICLE OF CLOTHING

(76) Inventor: Patricia A. Pelensky, 101 Mail Route Rd., Reading, PA (US) 19608

( * ) Notice: Subject to any disclaimer, the term of this patent is extended or adjusted under 35 U.S.C. 154(b) by 0 days.

(21) Appl. No.: 09/964,168

(22) Filed: Sep. 26, 2001

(65) Prior Publication Data

US 2003/0066117 A1 Apr. 10, 2003

(51) Int. Cl.[7] ..... A41F 3/00
(52) U.S. Cl. ..... 2/323; 2/69; 2/227; 2/232
(58) Field of Search ..... 2/323, 326, 338, 2/233, 231, 232, 69, 69.5, 75, 80, 227; 482/124, 122

(56) References Cited

U.S. PATENT DOCUMENTS 1,340,276 A * 5/1920 Koehne
4,115,906 A * 9/1978 Lavine et al. ..... 24/72
4,524,768 A * 6/1985 Serrao ..... 128/873
4,825,475 A * 5/1989 Smart ..... 2/312
5,176,600 A * 1/1993 Wilkinson ..... 482/124
5,267,928 A * 12/1993 Barile et al. ..... 482/124
5,357,637 A * 10/1994 Moore ..... 2/227
5,542,156 A * 8/1996 Oglesby ..... 24/72.1
5,918,318 A * 7/1999 Jones ..... 2/239
6,076,186 A 6/2000 Grose
6,101,631 A * 8/2000 Ferguson, Jr. ..... 2/94
6,158,057 A * 12/2000 Neumann ..... 2/312
6,161,223 A * 12/2000 Andrews ..... 2/234
6,163,937 A * 12/2000 McKinnis et al. ..... 24/302
6,339,847 B1 * 1/2002 Hanks ..... 2/269
6,393,619 B1 * 5/2002 Bardes ..... 2/232
6,438,756 B1 * 8/2002 Colorado ..... 2/81

OTHER PUBLICATIONS

Internet:http://www.poser.net/bondagepants/fabrics. Updated Oct. 20, 2000.*

Internet: http://shop.store.yahoo.com/streetgear/dpgirplaid-obo.html. Updated Sep. 11, 2001.*

* cited by examiner

*Primary Examiner*—John J. Calvert
*Assistant Examiner*—Alissa L. Hoey
(74) *Attorney, Agent, or Firm*—John J. Elnitski, Jr.

(57) ABSTRACT

An anti-climbing restraining strap attached to article of clothing made for a child. The restraining strap, which is incorporated into the article of clothing, aids in preventing a child from climbing over the railing of a crib, playpen or gate. The article of clothing includes two legs. The article of clothing includes at least one restraining strap between the legs of the article of clothing. The restraining strap is usually detachably fastened to at least one leg using fasteners to allow full mobility of a child, whereby the detached restraining strap is fastened to the article of clothing in some fashion to prevent an unsafe situation.

30 Claims, 5 Drawing Sheets

ANTI-CLIMBING RESTRAINING STRAPS ON AN ARTICLE OF CLOTHING

BACKGROUND

Parents use gates, cribs and playpens to restrain children from getting into dangerous situations. Children between one and three years old can become successful at climbing over gates, on to tables or out of their cribs or playpens. There are garments which restrict the ability of a child to climb over a gate or out of a crib or playpen. These garments usually also restrict all movement of the child. What is need is a means to prevent climbing by the child, yet allow the child to be mobile in their restricted environment.

It is an object of the present invention to provide restraining straps on an article of clothing which aids in preventing a child from climbing, while allow the child to be mobile.

SUMMARY OF THE INVENTION

An anti-climbing restraining strap attached to article of clothing made for a child. The restraining strap, which is incorporated into the article of clothing, aids in preventing a child from climbing over the railing of a crib, playpen or gate. The article of clothing includes two legs. The article of clothing includes at least one restraining strap between the legs of the article of clothing. The restraining strap is usually detachably fastened to at least one leg using fasteners to allow full mobility of a child, whereby the detached restraining strap is fastened to the article of clothing in some fashion to prevent an unsafe situation.

DETAILED DESCRIPTION OF THE INVENTION

Figure 1:
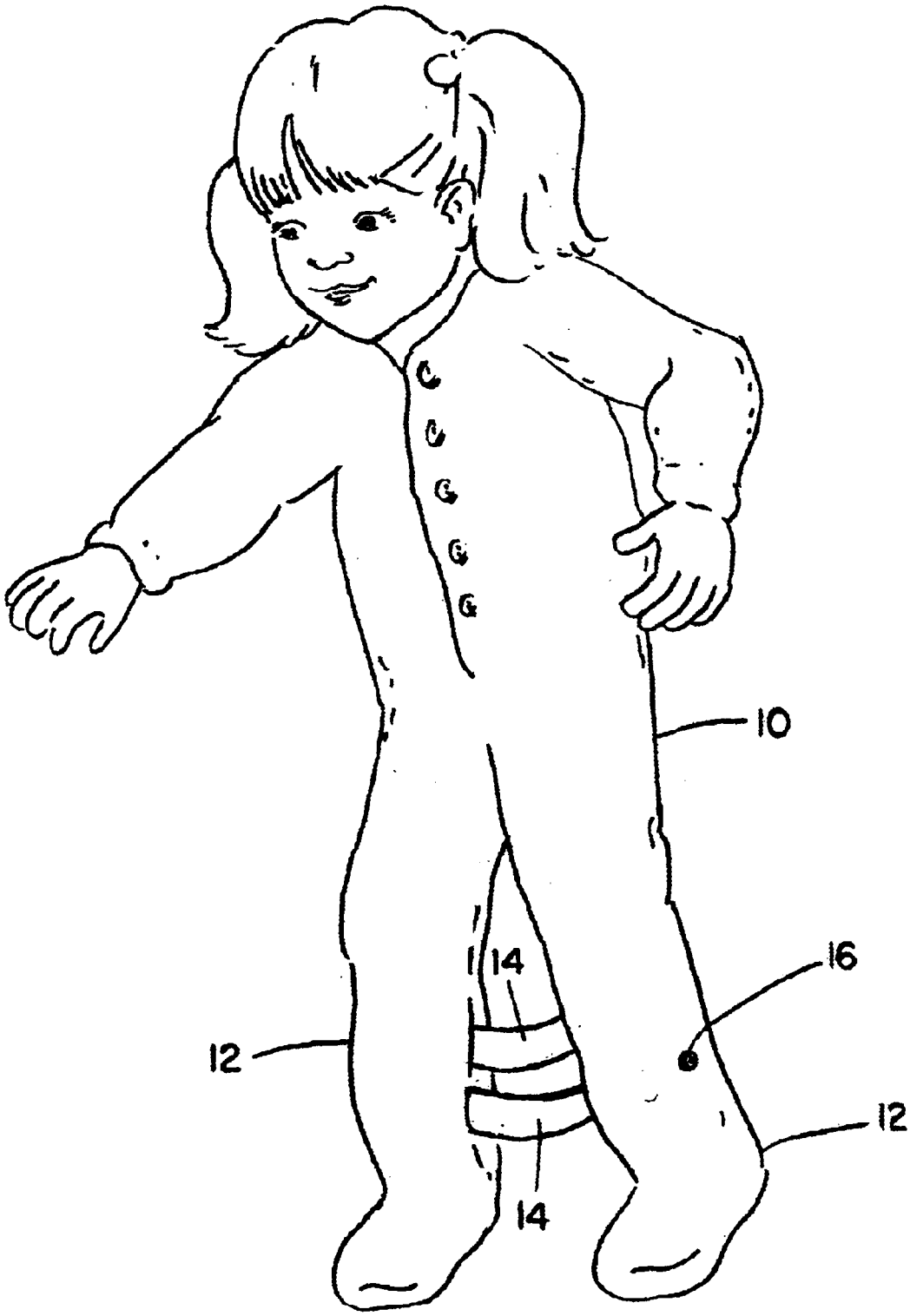
FIG. 1 is a front perspective view of restraining straps on an article of clothing according to the present invention.

The present invention is an anti-climbing restraining strap attached to article of clothing made for a child. The restraining strap, which is incorporated into the article of clothing, aids in preventing a child from climbing over the railing of a crib, playpen or gate. FIGS. 1–4 show an article of clothing 10 which is commonly know as a sleeper or jumper. The sleeper is a one piece article of clothing 10 which includes a pair of legs 12. FIG. 5 shows the article of clothing 10 as a pair of pants, which also includes a pair of legs 12. Either article of clothing 10 includes at least one restraining strap 14 between the legs 12 of the article of clothing 10. FIGS. 1–4 show two restraining straps 14, while FIG. 5 shows one restraining strap 14. The restraining strap 14 is usually detachably fastened to at least one leg 12 using fasteners to allow full mobility of a child, whereby the detached restraining strap 14 is fastened to the article of clothing in some fashion to prevent an unsafe situation.

Figure 2:
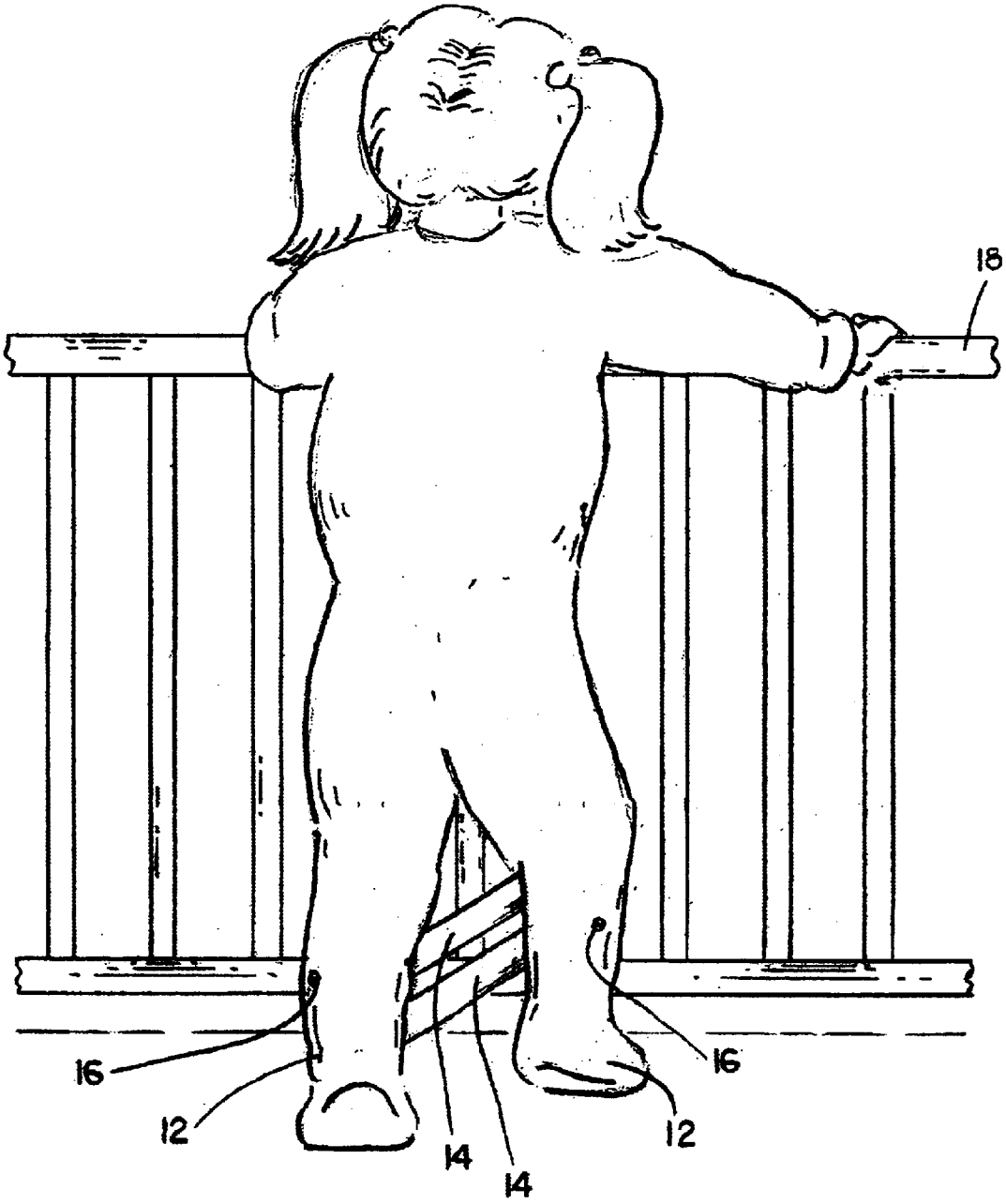
FIG. 2 is a rear perspective view of restraining straps on an article of clothing according to the present invention.
Figure 3:
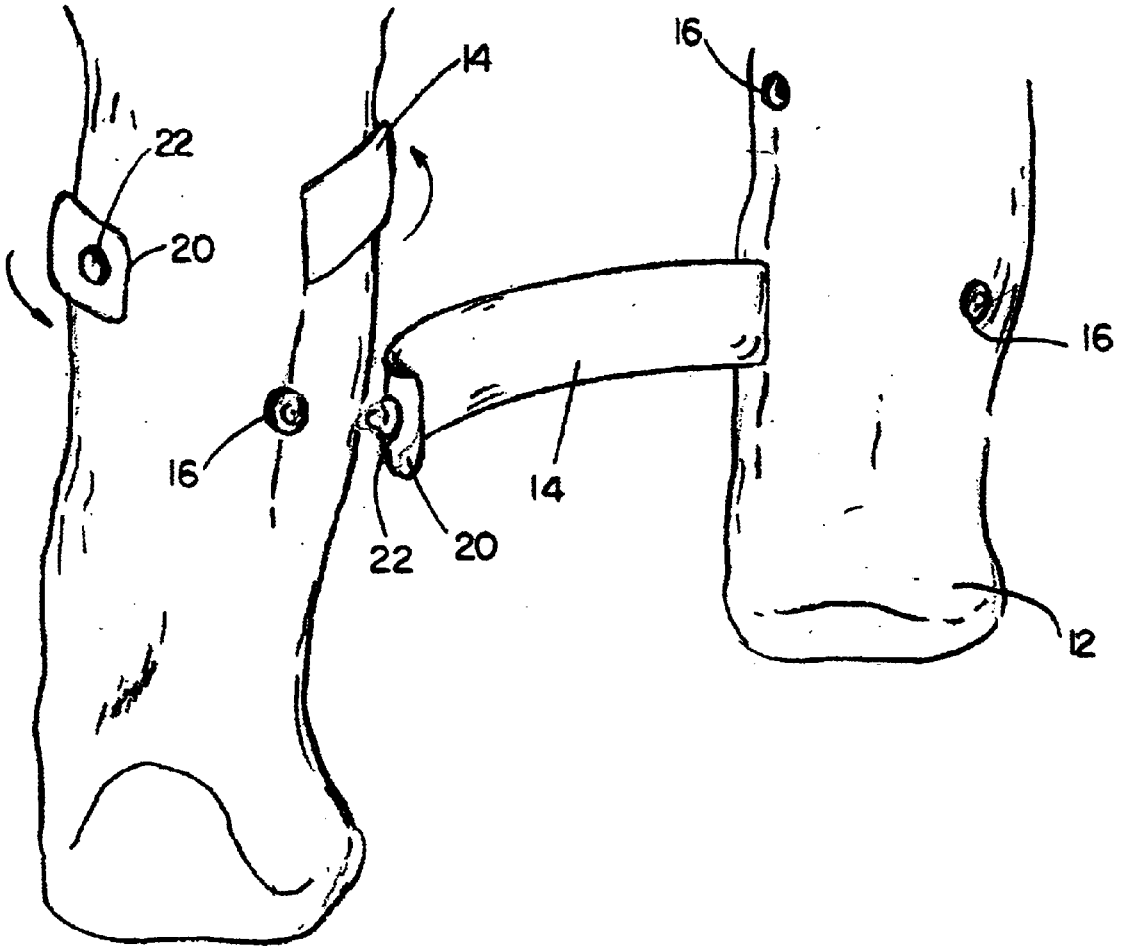
FIG. 3 is a rear close-up perspective view of restraining straps on an article of clothing according to the present invention.

FIG. 1 shows a front view of a child in a sleeper type article of clothing 10 which has a pair of legs 12. Attached between the legs 12 are two restraining straps 14. A female half button 16 of a snap type button assembly is shown on an outside side of a left leg 12 of the sleeper type article of clothing 10. FIG. 2 shows a rear view of the child in the sleeper type article of clothing 10, while the child is near a side of a crib 17. The female half button 16 of the left leg 12 can be seen, as well as, a female half button 16 on an outside side of a right leg 12 of the sleeper type article of clothing 10. FIG. 3 shows a close up of the attachment of the two restraining straps 14 on the sleeper type article of clothing 10.

As shown in FIG. 3, each restraining strap 14 has a sewn end 18 which is sewn into the material of the legs 12 of the sleeper type article of clothing 10. FIG. 3 shows one restraining strap 14 sewn to one leg 12, while the other restraining strap 14 is sewn to the other leg 12. It is envisioned that each restraining strap 14 could be sewn to the same leg 12, if desired. Each restraining strap 14 also includes a snap end 20 which includes a male half button 22 which is part of a snap type button assembly. FIG. 3 shows two additional female half buttons 16 on an inside side of the legs 12 of the sleeper type article of clothing 10. When in use, the retraining straps 14 are retained in place by snapping the male half buttons 22 of the snap ends 20 of the restraining straps 14 to the female half buttons 16 on the inside sides of the legs 12 of the sleeper type article of clothing 10. When the restraining straps 14 are not to be used, each restraining strap 14 is wrapped around each leg 12 of the sleeper type article of clothing 10 in which the restraining strap 14 is sewn. After each restraining strap 14 is wrapped around a leg 12 of the sleeper type article of clothing 10, each restraining strap 14 is secured by snapping the male half buttons 22 of the snap ends 20 of each restraining strap 14 to the female half buttons 16 on the outside sides of each of the legs 22 of the sleeper type article of clothing 10.

Figure 4:
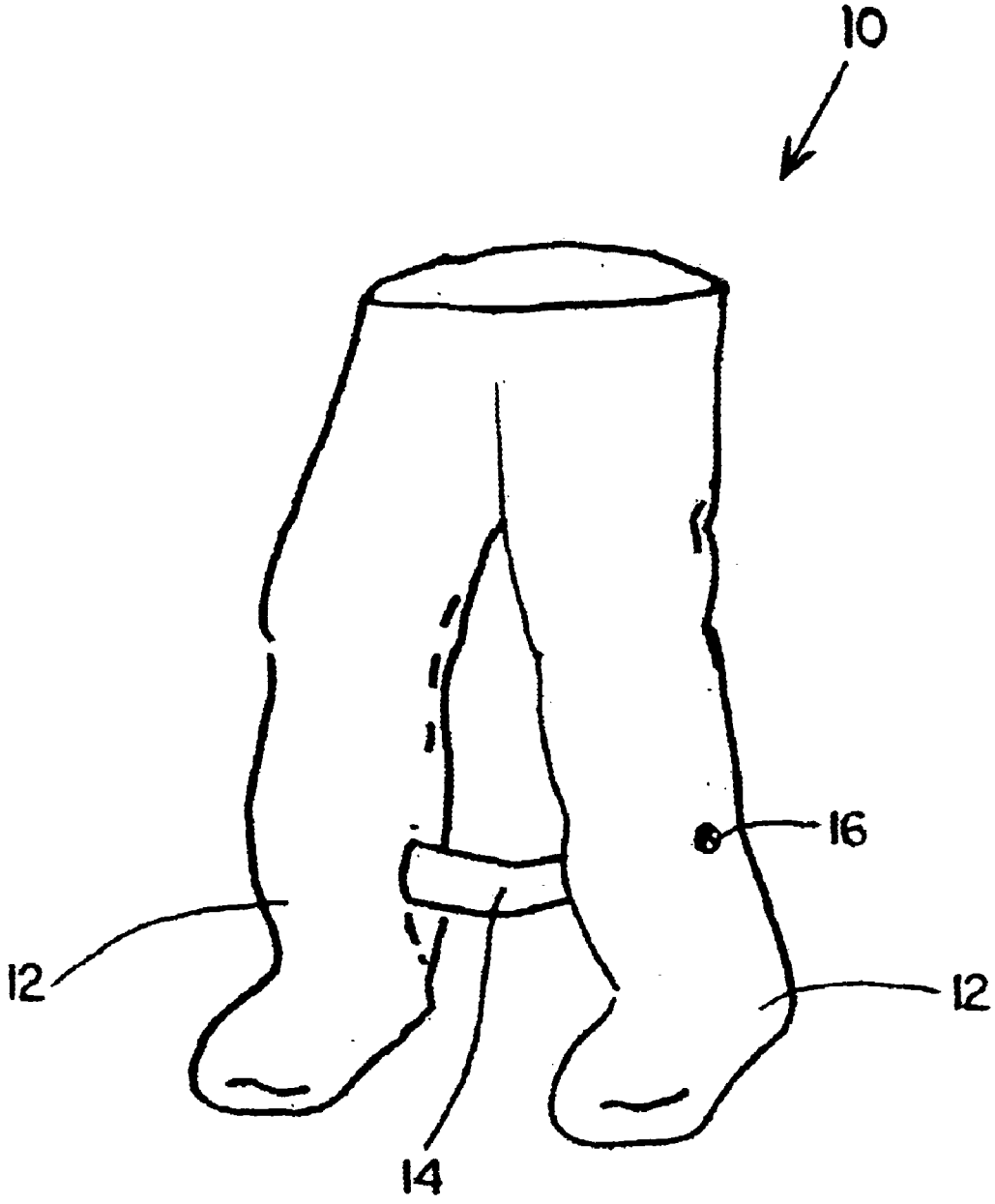
FIG. 4 is a front perspective view of restraining straps on another article of clothing according to the present invention.
Figure 5:
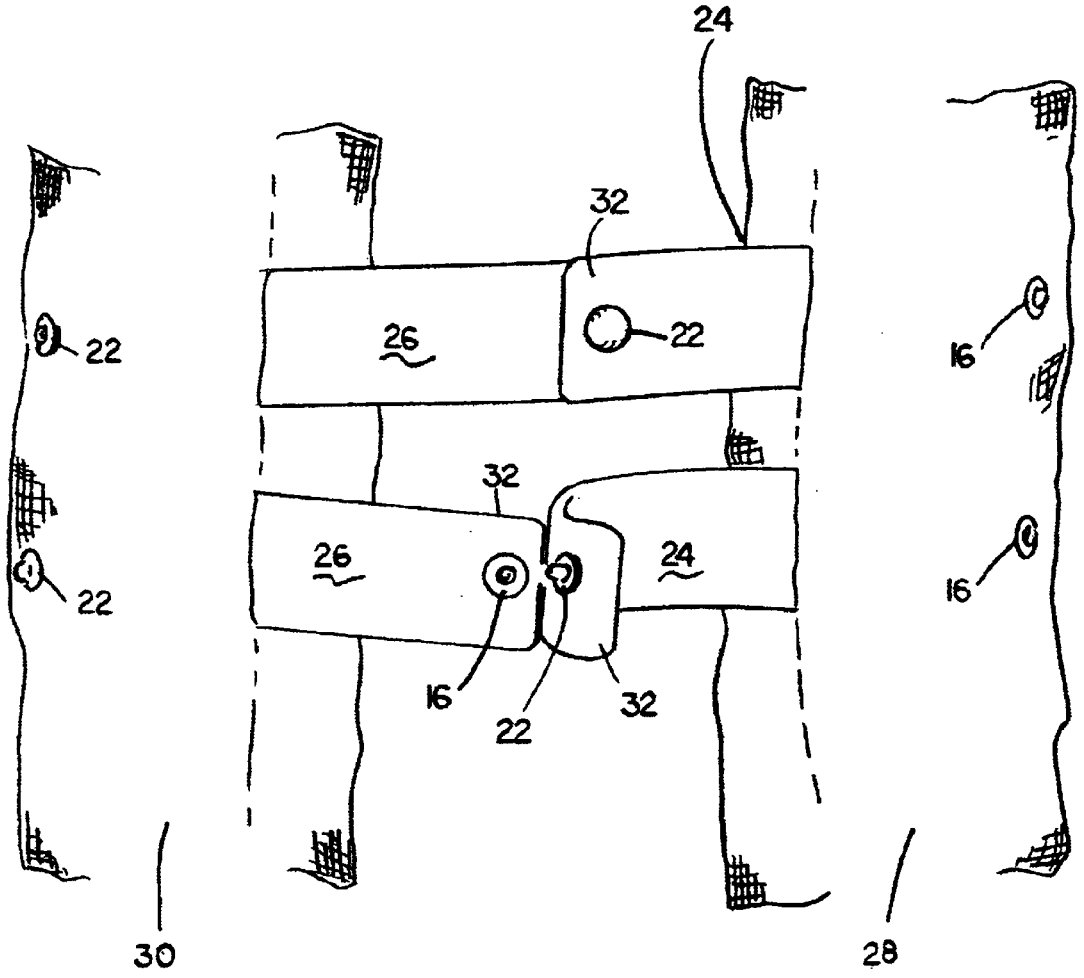
FIG. 5 is a perspective view of restraining straps on an article of clothing according to the present invention.

FIGS. 4 and 5 show two alternatives to the embodiment shown in FIGS. 1–3. FIG. 4 shows the present invention, whereby the article of clothing 10 is a pair of pants with just one of the restraining straps 14, as described above and shown in FIGS. 1–3. It is envisioned that two or more restraining straps 14 could be used with the pants, as described above and shown in FIGS. 1–3. FIG. 5 shows a restraining strap configuration of two restraining straps 14 made up of right and left strap halves 24, 26. Each restraining strap includes a right strap half 24 sewn to an inside side of a right leg 28 of an article of clothing and a left strap half 26 sewn to an inside side of a left leg 30 of an article of clothing. Each leg 28, 30 of the an article of clothing includes a set of two buttons. A set of female half buttons 16 of a snap type button assembly are shown on the right leg 28 of an article of clothing. A set of male half buttons 22 of a snap type button assembly are shown on the left leg 30 of an article of clothing. The right strap halves 24 have fastening ends 32 opposite of where the right strap halves 24 are sewn into the right leg 28. A male half button 22 of a snap type button assembly is positioned at the fastening end 32 of each right strap half 24. The left strap halves 26 have fastening ends opposite 32 of where the left strap halves 26 are sewn into the left leg 30. A female half button 16 of a snap type button assembly is positioned at the fastening end 32 of each left strap half 26. When in use, the right and left strap halves 24, 26 of each retraining strap 14 are fastened together by snapping the male half buttons 22 of the fastening ends 32 of the right strap halves 24 to the female half buttons 16 of the fastening ends 32 of the left strap halves 26. When the restraining straps 14 are not to be used, the right and left strap halves 24, 26 are wrapped around each leg 28, 30 of the article of clothing in which the right and left strap halves 24, 26 are sewn. After each of the right and left strap halves 24, 26 are wrapped around the legs 28, 30 of the article of clothing, the right strap halves 24 are secured by snapping the male half buttons 22 of the fastening ends 32 to the female half buttons 16 on the right leg 28 of the article of clothing and the left strap halves 26 are secured by snapping the female half buttons 16 of the fastening ends 32 to the male half buttons 22 on the left leg 30 of the article of clothing.

The restraining straps 14 prevent children from spreading their legs far enough apart to climb over an object higher than the waist of the child. The restraining straps 14 are usually positioned on an article of clothing 10 between the ankle area and the knee area of the legs of the article of clothing 10. The positioning of the restraining straps 14 in this manner allows prevention of a child from climbing over a railing, while allowing the child the ability to be mobile. When the restraining straps 14 are not in use and secured to the legs 12 of the article of clothing 10, the child has full mobility. It is envisioned that other fastening means instead of a snap button assembly may be employed with the restraining straps 14 and the legs 12 of the article of clothing 10.

I claim:

1. An article of clothing for restraining a child from climbing, consisting essentially of:

an article of clothing;

two legs as part of said article of clothing to cover legs of the child; and at least one restraining strap fastened between said two legs of said article of clothing, said at least one restraining strap fastened at a point between knee and ankle areas of each of said legs when worn.

2. The article of clothing of claim 1, wherein said at least one restraining strap includes two ends, wherein one of said ends is attached to one of said legs, while the other of said ends is attached to the other of said legs, and wherein at least one of said ends is detachable from one of said legs using detachable fasteners.

3. The article of clothing of claim 2, wherein both of said ends are detachable from said legs using detachable fasteners.

4. The article of clothing of claim 1, wherein there are at least two restraining straps fastened between said two legs of said article of clothing.

5. The article of clothing of claim 1, wherein said at least one restraining strap is detachable.

6. The article of clothing of claim 5, wherein said at least one restraining strap includes fasteners to fasten said detached at least one restraining strap to one of said legs to prevent an unsafe situation and allow full mobility of the child.

7. The article of clothing of claim 1, wherein said at least one restraining strap includes a sewn end and a snap end; wherein said sewn end is sewn to one of said legs; wherein the other of said legs includes a first snap half of a snap assembly; wherein said snap end includes a second snap half which mates with said first snap half to attach said snap end to the other of said legs including said first snap half.

8. The article of clothing of claim 7, wherein said leg which has said sewn end of said at least one restraining strap attached includes a first snap half attached, such that said at least one restraining strap can be secured to said leg which has said sewn end attached to prevent an unsafe situation and allow full mobility of the child when said at least one restraining strap is detached from said other leg.

9. The article of clothing of claim 1, wherein said at least one restraining strap includes two halves; wherein each half includes a sewn end and a fastening end; wherein each sewn end is sewn into one of said legs; and wherein each fastening end includes mating fasteners, such that the fastening ends of each of said halves of said at least one restraining strap may be fastened together.

10. The article of clothing of claim 9, wherein each of said legs includes fasteners to mate with said fasteners of each of said halves which are sewn to each of said legs, such that each of said halves can be secured to said leg which has said sewn end attached to prevent an unsafe situation and allow full mobility of the child when said halves are detached from each other.

11. The article of clothing of claim 1, wherein said article of clothing is a one piece sleeper type of article of clothing which includes said legs.

12. The article of clothing of claim 11, wherein said at least one restraining strap is detachable.

13. The article of clothing of claim 12, wherein said at least one restraining strap includes fasteners to fasten said detached at least one restraining strap to one of said legs to prevent an unsafe situation and allow full mobility of the child.

14. The article of clothing of claim 11, wherein said at least one restraining strap includes a sewn end and a snap end; wherein said sewn end is sewn to one of said legs; wherein the other of said legs includes a first snap half of a snap assembly; wherein said snap end includes a second snap half which mates with said first snap half to attach said snap end to the other of said legs including said first snap half.

15. The article of clothing of claim 14, wherein said leg which has said sewn end of said at least one restraining strap attached includes a first snap half attached, such that said at least one restraining strap can be secured to said leg which has said sewn end attached to prevent an unsafe situation and allow full mobility of the child when said at least one restraining strap is detached from said other leg.

16. The article of clothing of claim 11, wherein said at least one restraining strap includes two halves; wherein each half includes a sewn end and a fastening end; wherein each sewn end is sewn into one of said legs; and wherein each fastening end includes mating fasteners, such that the fastening ends of each of said halves of said at least one restraining strap may be fastened together.

17. The article of clothing of claim 16, wherein each of said legs includes fasteners to mate with said fasteners of each of said halves which are sewn to each of said legs, such that each of said halves can be secured to said leg which has said sewn end attached to prevent an unsafe situation and allow full mobility of the child when said halves are detached from each other.

18. The article of clothing of claim 1, wherein said article of clothing is a pair of pants which includes said legs.

19. The article of clothing of claim 18, wherein said at least one restraining strap is detachable.

20. The article of clothing of claim 19, wherein said at least one restraining strap includes fasteners to fasten said detached at least one restraining strap to one of said legs to prevent an unsafe situation and allow full mobility of the child.

21. The article of clothing of claim 18, wherein said at least one restraining strap includes a sewn end and a snap end; wherein said sewn end is sewn to one of said legs;

wherein the other of said legs includes a first snap half of a snap assembly; wherein said snap end includes a second snap half which mates with said first snap half to attach said snap end to the other of said legs including said first snap half.

22. The article of clothing of claim 21, wherein said leg which has said sewn end of said at least one restraining strap attached includes a first snap half attached, such that said at least one restraining strap can be secured to said leg which has said sewn end attached to prevent an unsafe situation and allow full mobility of the child when said at least one restraining strap is detached from said other leg.

23. The article of clothing of claim 18, wherein said at least one restraining strap includes two halves; wherein each half includes a sewn end and a fastening end; wherein each sewn end is sewn into one of said legs; and wherein each fastening end includes mating fasteners, such that the fastening ends of each of said halves of said at least one restraining strap may be fastened together.

24. The article of clothing of claim 23, wherein each of said legs includes fasteners to mate with said fasteners of each of said halves which are sewn to each of said legs, such that each of said halves can be secured to said leg which has said sewn end attached to prevent an unsafe situation and allow full mobility of the child when said halves are detached from each other.

25. An article of clothing for restraining a child from climbing, comprising:

an article of clothing;

two legs as part of said article of clothing to cover legs of the child; and at least one restraining strap fastened between said two legs of said article of clothing, wherein said at least one restraining strap includes two halves; wherein each half includes a sewn end and a fastening end; wherein each sewn end is sewn into one of said legs; and wherein each fastening end includes mating fasteners, such that the fastening ends of each of said halves of said at least one restraining strap may be fastened together.

26. The article of clothing of claim 25, wherein each of said legs includes fasteners to mate with said fasteners of each of said halves which are sewn to each of said legs, such that each of said halves can be secured to said leg which has said sewn end attached to prevent an unsafe situation and allow full mobility of the child when said halves are detached from each other.

27. An article of clothing for restraining a child from climbing, comprising:

a one piece sleeper type of article of clothing;

two legs as part of said one piece sleeper to cover legs of the child; and at least one restraining strap fastened between said two legs of said article of clothing, wherein said article of clothing is a one piece sleeper type of article of clothing which includes said legs, wherein said at least one restraining strap includes two halves; wherein each half includes a sewn end and a fastening end; wherein each sewn end is sewn into one of said legs; and wherein each fastening end includes mating fasteners, such that the fastening ends of each of said halves of said at least one restraining strap may be fastened together.

28. The article of clothing of claim 27, wherein each of said legs includes fasteners to mate with said fasteners of each of said halves which are sewn to each of said legs, such that each of said halves can be secured to said leg which has said sewn end attached to prevent an unsafe situation and allow full mobility of the child when said halves are detached from each other.

29. An article of clothing for restraining a child from climbing, comprising:

a pair of pants;

two legs as part of said pair of pants to cover legs of the child; and at least one restraining strap fastened between said two legs of said article of clothing, wherein said at least one restraining strap includes two halves; wherein each half includes a sewn end and a fastening end; wherein each sewn end is sewn into one of said legs; and wherein each fastening end includes mating fasteners, such that the fastening ends of each of said halves of said at least one restraining strap may be fastened together.

30. The article of clothing of claim 29, wherein each of said legs includes fasteners to mate with said fasteners of each of said halves which are sewn to each of said legs.

* * * * *